United States Patent [19]

Ehlert et al.

[11] Patent Number: 4,660,621

[45] Date of Patent: Apr. 28, 1987

[54] CONTINUOUS CASTING OF LAMINATE PRODUCTS

[75] Inventors: Klaus-Peter Ehlert, Moers; Achim Kubon, Neukirchen, both of Fed. Rep. of Germany

[73] Assignee: Mannesmann AG, Duesseldorf, Fed. Rep. of Germany

[21] Appl. No.: 684,596

[22] Filed: Dec. 21, 1984

[30] Foreign Application Priority Data

Dec. 22, 1983 [DE] Fed. Rep. of Germany ..... 3346391

[51] Int. Cl.[4] ..... B22D 19/02; B22D 11/10

[52] U.S. Cl. ..... 164/461; 164/419

[58] Field of Search ..... 164/461, 419; 198/650; 428/615

[56] References Cited

U.S. PATENT DOCUMENTS 3,710,844 1/1973 Doi et al. ..... 164/461
4,098,319 7/1978 Brinkmann ..... 164/461
4,356,618 11/1982 Jordan ..... 164/461
4,479,530 10/1984 Ekerot ..... 164/461
4,516,626 5/1985 Liberman ..... 164/461

*Primary Examiner*—Nicholas P. Godici
*Assistant Examiner*—Samuel M. Heinrich
*Attorney, Agent, or Firm*—Ralf H. Siegemund

[57] ABSTRACT

The invention provides for a lowering of sheet stock into a mold for continuous casting. The rate of cooling of the molten metal as so fed within the mold is determined by a particular mass throughput in conjunction with the surface area being offered by the sheet stock as it is being lowered into the mold. That surface area in particular will be determined by providing more than one sheet to be run into the mold in parallel relationship. Of course the number of sheets may be determined by the laminate structure being desired. It is important that the casting of metal around the lowered sheet stock occurs outside of the range of feeding molten metal into the mold. This way it is avoided that the temperature in the mold is lowered to the point of "freezing" while on the other hand cooling is not unduly delayed.

13 Claims, 9 Drawing Figures

(A-A)

CONTINUOUS CASTING OF LAMINATE PRODUCTS

BACKGROUND OF THE INVENTION

The present invention relates to continuous casting for the manufacture of multilayer components whereby molten metal, for example molten steel, is in some fashion combined with sheet stock.

Multilayer integral or laminated components can presently be made only through rolling, welding or mold casting on a discontinuous basis. The welding or rolling methods are disadvantaged by the fact that the individual layers of the compound component are inadequately bonded together whereby a bond is to be understood only in a sense of a homogenic material texture sufficient to be able to take up different types of loads without delamination. Usually deficiencies along that line show up already for example during further working such as deforming or forming the component to obtain a reduced wall thickness.

Presently however desired compound components of the multilayer variety are of increasing interest particularly for example in the case of pipes of relatively large diameter. It is known for example through publication in VDI Nachrichten (VDI news) No. 23, page 8 of June 10, 1983 to provide multi-layer compounds in a particular manner, using a pilot process for making a natural gas pipeline in a multilayer compound fashion. It was found that just an increase in pipe diameter is not a technical economical feature just for increasing the flow cross-section so as to increase the throughput of such pipes. Increasing pipes above the presently deemed optimum pipe diameter of 1420 mm appears to be impractical as per the present time. Throughput is increased for example by increasing the pumping pressure up to 100 or 120 bars. For these pipes a well thickness of 35 mm are required.

During cooling of continuously cast metal such as steel it has become known through a handbook by Erhard Hermann, 1958 (Handbuch des Stranggiessen, Seite 153) to introduce compact material for example in the form of a rolling rod made of the same steel. This rod does not have to melt completely but becomes an integral part of the casting. This particular method, however, is limited to the concept of supplementing the cooling in the interior of the casting head under utilization of the solid rod being introduced and having the same composition. Therefore this particular method does not produce a multilayer component in which the different layers have different properties. Moreover the resulting product is not comparable with the product envisioned in the present invention.

DESCRIPTION OF THE INVENTION

It is an object of the present invention to provide a new and improved method for continuous casting for the making of multilayer components using in addition to the molten metal certain sheet stock to be introduced into the mold for continuous casting in such a manner that on one hand a "freezing" into the mold is avoided while on the other hand a rapid and uniform cooling is obtained resulting in a desirable homogenic material texture.

The object of the present invention is obtained by introducing the sheet stock to be used for forming a particular layer in a compound product outside of the zone in a mold for continuous casting into which the metal is being poured and that the cooling of the molten metal as so poured is made dependent upon predetermined mass and number of sheet stock as introduced.

Thus in accordance with the preferred embodiment of the present invention the objective is met by providing for a lowering of sheet stock into a mold for continuous casting in portions laterally offset from points of feeding the mold with molten metal. The rate of cooling of the molten metal as so fed within the mold is determined by a particular mass throughput in conjunction with the surface area being offered by the sheet stock as it is being lowered into the mold. That surface area in particular will be determined by providing more than one sheet to be run into the mold in parallel relationship. Of course the number of sheets may be determined by the laminate structure being desired. It is important that the casting of metal around the lowered sheet stock occurs outside of the range of feeding molten metal into the mold. This way it is avoided that the temperature in the mold is lowered to the point of "freezing" while on the other hand cooling is not unduly delayed.

A particular improvement is to be seen in that in the case of a long rectangular casting cross section the molten metal is introduced into the mold in end portions of that rectangle while the sheet stock is introduced in more central portions. Subsequently the portion of the casting not containing sheet stock is cut off; that cut off may occur immediately after the casting or after rolling simply for ease of severing operations.

In order to make sure that the product has the desired laminated property in a consistent fashion the sheet stock should be introduced into the mold with particular spacing requirements actively maintained throughout the introduction process so that the sheets as they are being lowered into the mold have the desired spacing among each other as well as the desired spacing from the mold wall.

The inventive method offers the advantage that the layers of the sheet stock and the casting material assume a texture of intimate bonding which permits subsequently for deformation of the completed castings for example by means of rolling without delamination.

A compound, multilayer or laminated product made in accordance with the method has the property of permitting higher stress as compared with monolithic material, and tension cracks as they may occur are in effect stopped and will not migrate further at the lamination boundaries. From the point of view of thermal conditions no objections can be raised against the introduction of sheet stock into the molten metal because the rate of feeding and the quantity of metal of sheet stock introduced is such that the sheet stock will not completely melt. In addition it is suggested that the sheet stock have a minimum distance from each other in the direction of casting thickness being approximately the three-fold of the thickness of the sheets themselves and this distance is continuously maintained. Such minimum distance makes sure that there is controlled cooling from the outside to the inside whereby the cooling of the core region of the casting is made possible through a central sump and a heat transport from the core region towards the outside is made possible when these distances are observed.

A different mode of cooling obtains and leads to a modified length of the liquidous core or sump by increasing the mass of the sheet stock in proportion to a preheating of the sheet. Accordingly it is suggested to preheat the sheet stock to a temperature well above ambient which is of course immediately and directly effective in the heat transport phenomena which obtain in the interior of the mold.

Another improvement of the inventive method will result from selecting the number of sheet stock, with a predetermined distance of the sheets among each other, under uniform mass of the sheet stock introduced as a whole. That relation must be made dependent upon the small dimensions of the casting cavity (thickness dimension), and for an appropriately selected number of sheet stocks one obtains a constant cooling rate over the cross section.

For practicing the inventive method equipment is proposed in which individual sheets are guided through a transverse transport device from a store in which the sheets may be stored at the desired spacing as far as parallel positioning is concerned, to a disposition in vertical alignment with the mold. Thereupon the sheets are lowered at a relatively fast rate to catch up with the sheet or sheets currently introduced into the mold at a relatively low rate and by means of one or several motors that drive the advance of the sheet into the mold. Sheets being aligned in that fashion in vertical direction are being interconnected so that from an overall point of view continuous feeding of sheet stock into the mold is obtained. Alternatively sheet stock can be fed from a coil on a truly continuous basis.

The equipment furthermore may include generally a rectangular mold and the feeding of sheet stock is arranged centrally while the molten metal is introduced through casting pipes into edge or end near portions of the mold. These casting pipes extend from the legs of a U-shaped tundish which in turn is being fed with molten metal in the bottom portion of the U thereof. This way the U-shaped tundish so to speak grips around the sheet feeding structure.

In the case of casting in a curve it is necessary to have several sheets as they are introduced individually advanced and lowered by individual motors because the curving occurs in relation to an axis that runs parallel to the flat extensions of the sheet so that the radius of curvature of the individual sheets differs slightly requiring accordingly somewhat modified travel paths and sheet advance.

The equipment for handling the sheet stock above the mold should be provided with guide rolls and stop means for accurately determining the path of each individual sheet.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
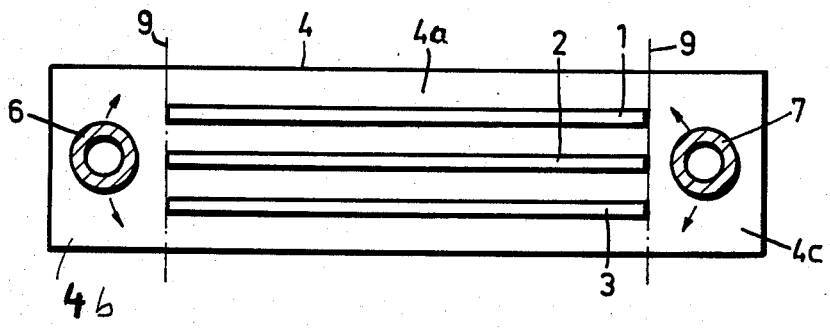
FIG. 1 illustrates a view into a mold for continuous casting in a first example for introducing sheet stock, for forming a particular layer in a compound product showing also the arrangement of the sheet stock within a casting space of the mold for continuous casting, in order to practice the preferred embodiment of the present invention in accordance with the best mode of practicing thereof.
Figure 2:
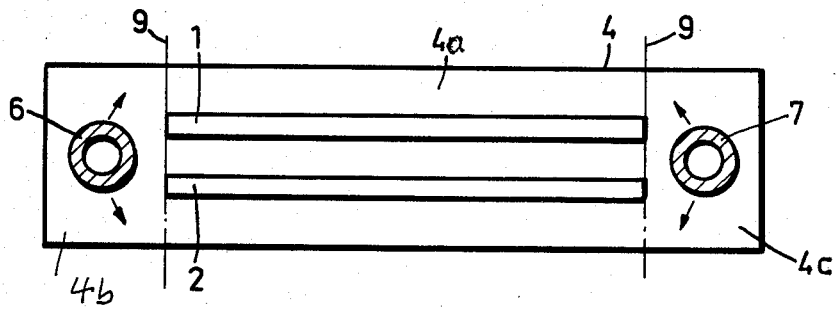
FIG. 2 is similar to FIG. 1, but illustrates a modified arrangement of sheet stock still being within the purview of the preferred embodiment.
Figure 3:
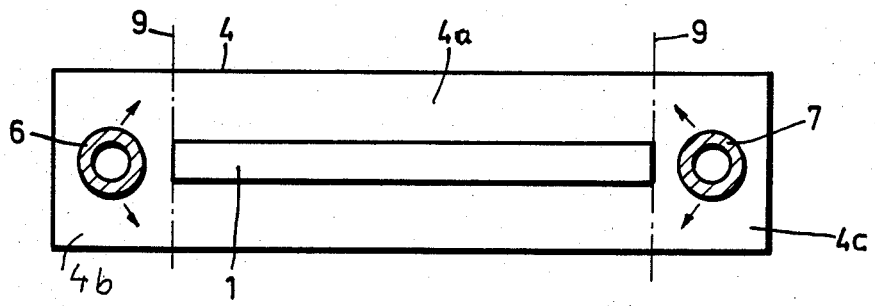
FIG. 3 is similar to FIG. 1, but illustrates a third example for arranging sheet stock still within the purview of the preferred embodiment.
Figure 5:
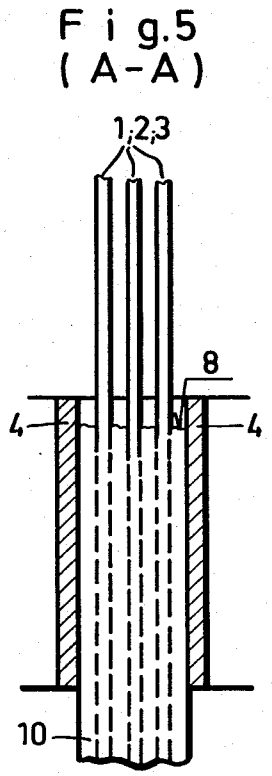
FIG. 5 is a cross sectional view in accordance with the section plane A—A in FIG. 4 through the mold for continuous casting including introduced sheet stock.

Proceeding now to the detailed description of the drawings reference is first made to FIGS. 1, 2, and 3. These figures show pieces of sheet stock such as 1, 2 and 3 which are introduced vertically, i.e. perpendicularly to the plane of the drawings of FIGS. 1,2, and 3 into the mold 4 for continuous casting. The mold is provided for casting rectangular ingots. The sheet stock 1, 2, and 3 is not as wide as the mold as wide leaving, as per the drawings, to the left and to the right certain end portions of the mold such as 4*b* and 4*c* unoccupied by sheet stock.

Casting pipes spouts or tubes 6 and 7 extend, from a tundish 12 (see FIG. 4) above the mold 4, in down direction and particularly into these areas 4*b* and 4*c* outside of the zone 4*a* occupied by the sheet stock 1, 2, and/or 3. Molten metal therefore flows through these casting pipes 6 and 7 into the mold and alongside the sheet stock 1, 2 and/or 3. The molten metal 5 is distributed into the mold and particularly between the pieces of sheet stock. This being basically the steady state or continuous mode of operation.

The start-up is carried out slightly differently. Start-up of continuous casting generally requires filling of the mold 4 to some extent without yet withdrawing the casting which required that for example a stool or the like to close the bottom opening of the casting mold in a manner known per se. The start-up process requires basically two operations. One is the initial filling of the mold being closed at the bottom as stated until a particular casting height such as a level 8 (FIG. 4) has been reached. The other operation is the introduction of the sheet stock 1, 2, and/or 3. After both of these operations have been completed the stool is withdrawn and the initial casting can be withdrawn whereupon steady state operation is continued. This requires a continuous pouring of molten metal 5 through the spouts 6 and 7 from the tundish 12 into the mold. The lubrication between mold 4 on one hand and molten steel 5 on the other hand is carried out for example by means of oil or grease in order to avoid introduction of impurity particles into the casting strand or ingot. A protective gas atmosphere should be maintained above the level 8 in order to avoid reaction of the molten metal with for example oxygen or the like.

The solidification of the material particularly as it is withdrawn from the bottom of the mold depends, particularly for higher casting speeds, on the following parameters. First of all the mass i.e. the weight of the sheet stock 1, 2 and/or 3 is decisive in the solidification process because this sheet stock as it is being introduced and continuously fed into the mold introduces a certain cold component into the molten metal tending to cause the molten metal 5 to solidify within the mold. Clearly the dimensions of that sheet stock in relation to the overall cross section of the mold for continuous casting is a further parameter. Another parameter for a given mold size is the number of sheet stock pieces and of course the particular inherent temperature dependent parameters and characteristics of the sheet stock.

Figure 7:
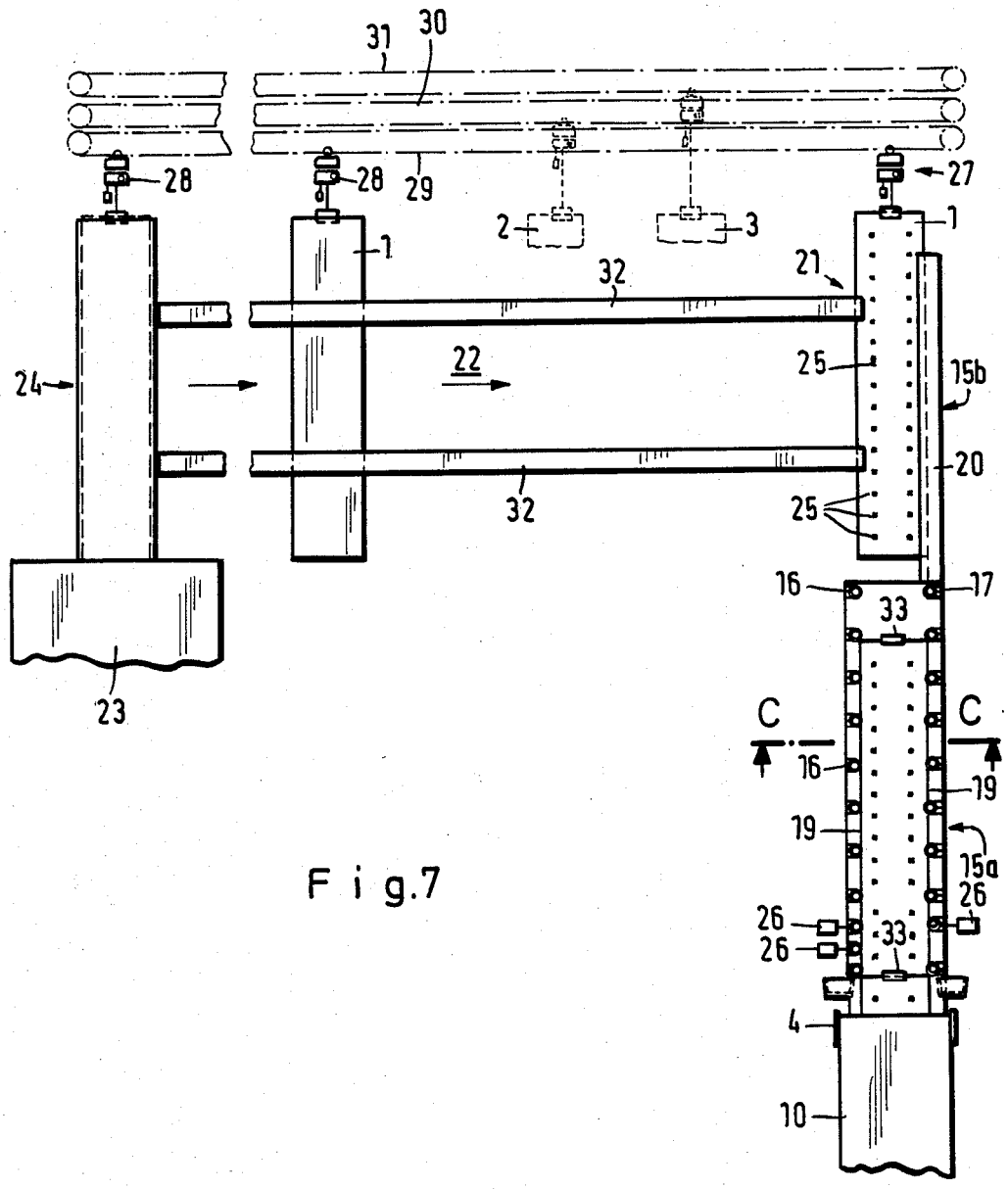
FIG. 7 includes the guide structure for the casting mold with transverse transport equipment to be used in the equipment shown in FIG. 6; the view angle being 90° shifted but still in the horizontal.
Figure 8:
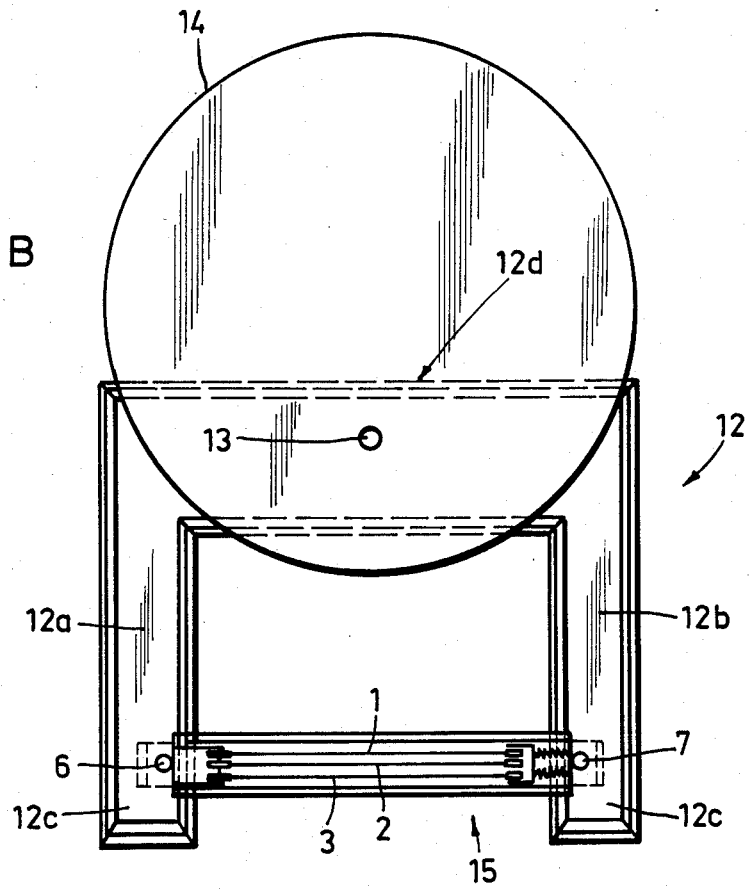
FIG. 8 is a top view as indicated by the arrow-direction B in FIG. 6.

In order to provide for certain comparison it is assumed that FIGS. 1, 2, and 3 use the same mold and that the sheet stock introduced differs in thickness such that the mass i.e. the insertion of sheet stock quantity in terms of weight—mass is the same. This in turn means that in FIG. 1 the sheet stock is fairly thin but the three sheets are equivalent to the single sheet of FIG. 3 or the two sheets of FIG. 2. In FIG. 3 the sheet stock has twice the thickness of the two sheets shown in FIG. 2 and the sheets 1, 2, and 3 each have one third the thickness of the sheet in FIG. 3. The various pieces are maintained at a particular spacing whereby as an overall rule a minimum distance from one sheet to the next one and the mold wall should be at least three times the respective sheet thickness. The particular distance maintained by means of a guide structure is to be explained more fully below with reference to FIGS. 7, 8 and 9.

By way of example the inventive method may operate in accordance with the following data. The melting weight may be 220 tons (metric), the long mold width is 2600 mm and the mold short width is 250 mm. A casting speed of 0.9 m per minute is assumed and in the case of FIG. 1, i.e. three sheets are used each having at length of 80 m, a width of 1.6 m, and a thickness of 10 mm, the weight of the sheets amounts to 1 ton. For particular special effects each of the sheets may carry particular layers or coating. As will be described below, the sheets are fed into the mold on a continuous basis.

Upon continuously feeding and introducing the sheet stock 1,2, and/or 3 into the mold the molten metal will flow around these sheets but a dissolution of them is avoided. For this it may be advisable to preheat the sheet stock 1,2, and 3 so as to avoid excessive heat transfer from the molten metal into the sheets. The preheating of the sheet stock 1, 2, and 3 is of course not totally avoidable nor is it desirable to avoid heating of them completely. Rather they are in fact bonded softly into the surrounding but now solidifying molten metal 5 whereby these sheet stocks will soften sufficiently so as to accomodate for example a curved mold of casting, particularly as the casting is withdrawn from the mold and veered towards the horizontal.

Figure 4:
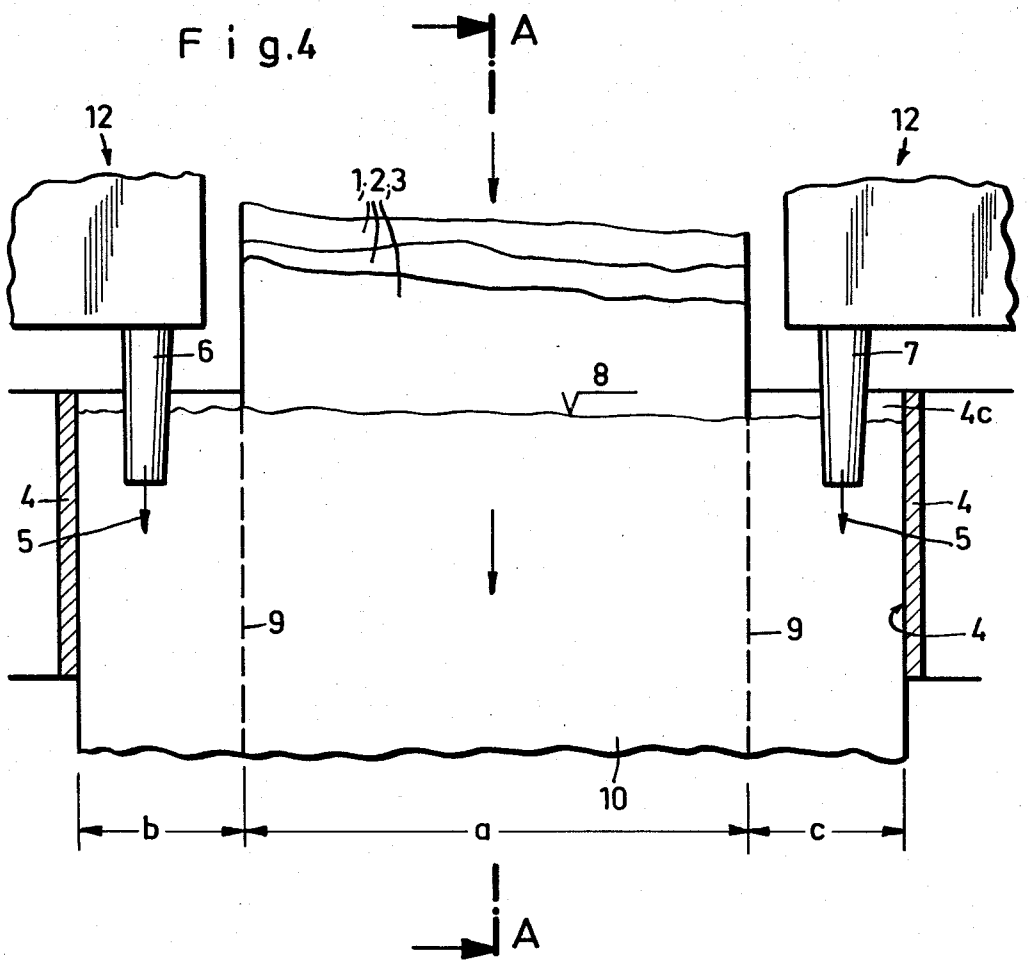
FIG. 4 is a longitudinal cross-section through a mold for continuous casting for the casting of compound and layered or laminated components to be seen in longitudinal direction.
Figure 6:
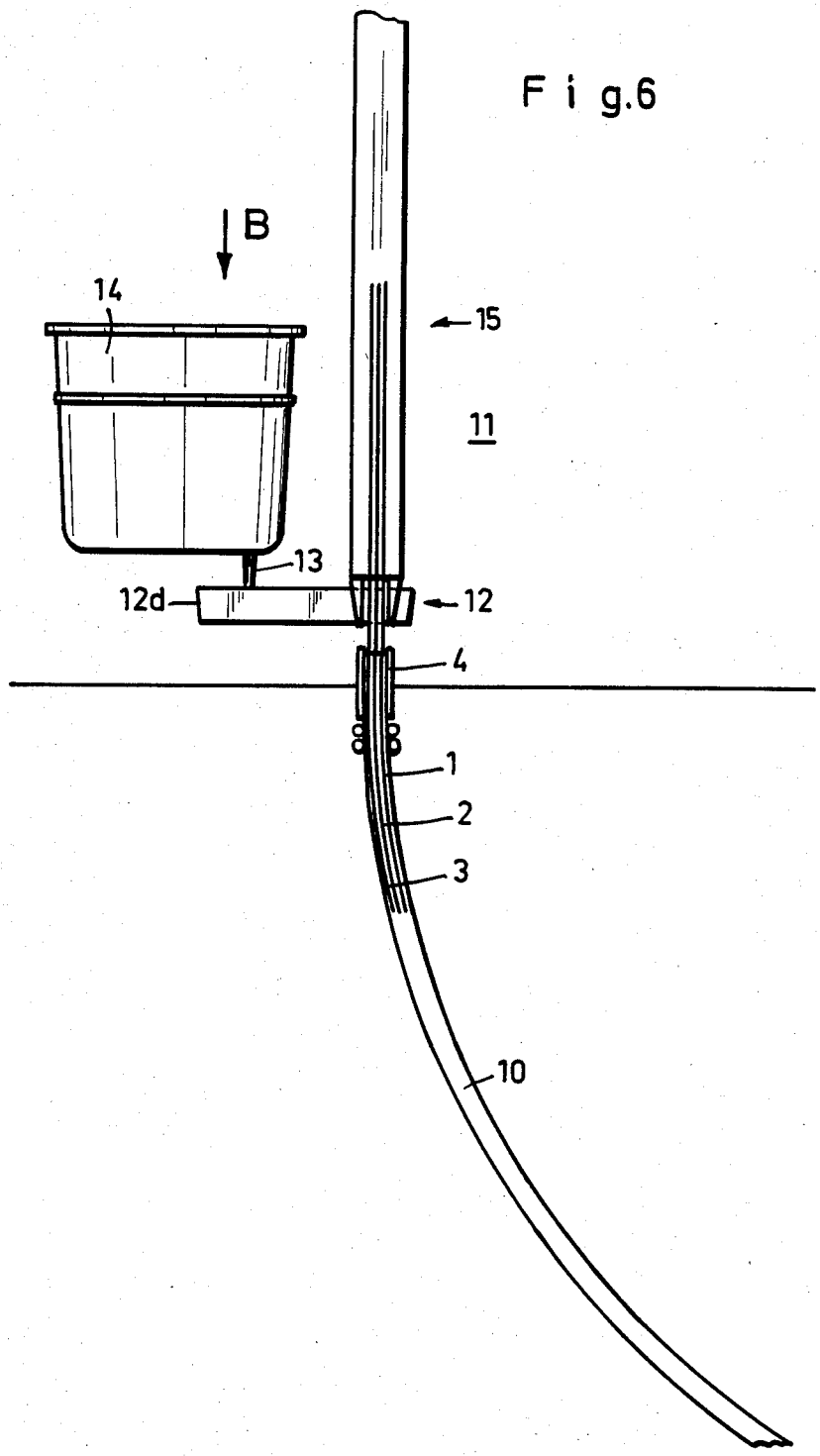
FIG. 6 is a somewhat schematic side elevation of equipment for casting a compound product on a continuous basis in accordance with the preferred embodiment of the present invention.

As indicated by edges 9 in FIG. 4, (this can also be seen from FIGS. 1, 2, and 3), it is clear that the sheets are not as wide as the mold. Therefore the casting 10 as it is produced can be deemed to be hypothetically divided into sections a, b, and c whereby b and c constitute the end portions more or less below directly the casting spouts and pipes 6, 7 while section a includes the sheets as they are softened. These end portions b and c may later be cut off the casting and recycled so that the layered portion remains strictly a compound or multilayer product. Alternatively the completed casting 10 may be rolled without such modification i.e. while maintaining and retaining the end portions b and c which may for example become an integral part of the final product.

As the casting is rolled the thickness of the inserted sheet stock material 1, 2 and 3 is diminished in proportion to the thickness of the surrounding material originating from the molten metal whereby crystalline cold or hot deforming establishes a bond between the molten metal 5 as it existed originally and the sheet stock material of sheets 1, 2, and/or 3. The sheets 1, 2, or 3 should of course be different, as far as material is concerned, from the metal used as the basic metal 5 in the casting procedure. However the sheets 1,2 and/or 3 do not have to be all similar but may be made of different composition and/or consistency. This selection may depend on the various parameters including the use of the product to be made and under consideration particularly of the specific type of load the component is to take up later on. Here it may be for example that particular additives in the sheet stock are decisive parameters under consideration of tube or pipe requirements. This is particularly the case if the casting as made will be rolled later on and used for making tubes or pipes. The weight for the sheet stock in the tube making process to be used for tubes or pipes which can withstand pressure up to 120 bars and even higher can be drastically reduced by using the process of the invention.

A structure and devices for carrying out the inventive method are particularly shown in FIGS. 4 through 9. The level range or area 11 above the mold 4 for continuous casting contains the distributor or tundish 12 having basically a U-shaped configuration in horizontal elevation. The U-shaped legs 12*a* and 12*b* have end portions positioned above the sections b and c of the mold 4 and they include particularly the casting spouts 6 and 7. The central portion 12*d* (being the bottom of the U) on the other hand is situated under the outlet 13 of a casting vessel or ladle 14 to receive therefrom molten metal.

A guide structure 15 is provided in the area 11 above the mold 4 and the tundish 12 which guiding structure has the task of running the sheet stocks 1, 2 and 3 individually into the mold but in a common mode of operation so as to maintain a continuous operation of sheet feeding and an accurate distance to the long mold walls. Specifically there should be a continuous advance of these sheets under consideration of the casting speed and depending upon the disposition of these sheets within the casting 10 (for example FIG. 6).

The guiding structure 15 has, as far as its vertical arrangement is concerned, a lower section or portion 15*a* and an upper section or portion 15*b*. The lower portion 15*a* is essentially established by stationarily journaled guide rolls or sleeves 16 facing resiliently journaled guide rolls or sheaves 17 (FIGS. 7 and 9) across the feed path for the sheet stock. The guide rolls 16 and 17 are comprised of so called sizing or gauging rolls i.e. cylindrical, roll-like bodies having annular grooves 18. The sheet stock 1, 2, and 3 have their respective front edges 19 engaged by the grooves 18 and abut against the respective bottoms thereof. This way a very accurate guidance of the sheets 1, 2, and 3 in three planes is established.

The vertically upper section or portion 15*b* of the guide structure 15 is essentially comprised of abutment rails 20 which position the front edges 19 of the sheet stock 1, 2, and 3 in allignment with the lower section 15*a*. The abutment rail 20 is preferably part of the guide structure 15 as far as the vertical direction is concerned while simultaneously it constitutes the end portion 21 of a transverse transport device 22 which moves the sheet stock in horizontal direction.

The transverse transport device 22 extends between the end portion 21 i.e. the vertically upper section 15*b* of the guide structure, and the store 23 for sheet stock 1, 2, and 3 whereby for each size or gage of sheet the store 23 includes several containers 24. Sheets of the same size are arranged in FIG. 7, one above the other and in a manner similar to cassette storage. Each of these cassette like stores 24 for the sheet stock 1, 2, and 3 hold these sheets after they have been cut to suitable length. The store 23 is thus a store for sheet stock of a general nature, but the sheets should be stored therein in a prearranged fashion, including already to desired spacing.

Figure 9:
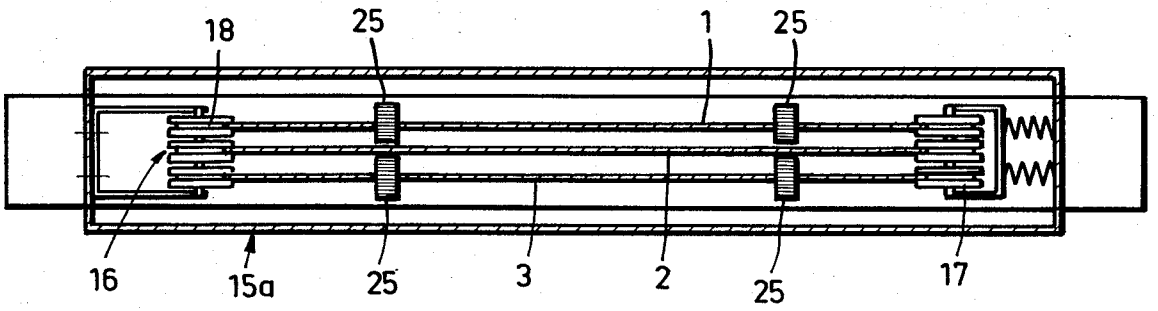
FIG. 9 is a cross section through the guide equipment in accordance with section plane C—C in FIG. 7.

It should thus be noted that the sheets such as 1,2, and 3 to be lowered into the mold subsequently are already stored in the container 24 under utilization of spacers 25 as shown in FIG. 9. The spacers 25 for example separate the sheets 1 and 3 to a sufficient extent so that the sheet 2 does not require any additional spacing.

It is of course possible to operate from a continuous coil of sheet stock whereby the length in accordance with the sheet to be inserted into the mold 4 is stretched sectionwise.

The individual guide rolls 16 pertaining to the lower section 15*a* of the guide structure are stationary as to journaling as stated and are connected to motors 26. In this case then each sheet such as 1,2, or 3 is associated with a plurality of separated advancing motors 26 so as to permit individual lowering of the respective sheet. This however requires that a sheet be moved from the transport section 22, down to the sheet feeding section 15*a*. The lowering proper includes devices 26 such as grips 28 which are moved continuously along transport paths 29,30, and 31. In operation a particular clamping or holding device 28 grips the particular piece of sheet stock such as 1 (see FIGS. 1 and 7)and moves the same between the curved pairs of rails 32 until the sheet abuts the stop rail 20. As stated before the lower section 15*a* includes advancing motors 26 which in fact control at a rather slow rate the feeding and descent of individual sheets into the mold. This descent is comparatively slow. As such a sheet is lowered into the mold by operation of the motors 26 another sheet such as 1 has been placed in registering vertical alignment above the sheet being lowered and the clamping holder 28 positioning such a sheet above one that is being lowered by motors 26, will lower the new sheet faster than the latter sheet currently being lowered by the motors 26. In other words a new sheet is, so to speak, made to catch up with one that is being lowered. By means of coupling such as 33 the leading (lower) edge of the new sheet is coupled to the trailing (upper) edge of the one that is being lowered into the mold currently and in part has dipped into the molten metal.

It can thus be seen that through the discontinuous feeding handling of these sheets is facilitated but the structure is such that the individual sheets are being combined longitudinally so as to obtain in fact a continuous feeding of sheet stock directly into the mold. It will be understood that additional facilities and sheet lowering devices may be provided in planes parallel to the plane of the drawing of FIG. 7 if in fact such sheets are run into the mold in the parallel configuration. The respective sheet stock 1,2, and 3 etc. will be guided through guide rolls 16 during lowering so as to obtain a very accurate positioning vis-a-vis the long mold walls. The resilient guide rolls 17 as shown in FIG. 9 as well as the grooves 18 vis-a-vis the mold wall 4*c* guide the sheet accurately in relation to the longitudinal or long side walls of the mold 4. Thus the required metallurgical conditions outlined above and having to do with the spacing of the sheets and positioning thereof within the casting being formed can indeed be observed.

The invention is not limited to the embodiments described above but all changes and modifications thereof not constituting departures from the spirit and scope of the invention are intended to be included.

We claim:

1. Method of continuously casting multilayer compound parts under utilization of a relatively wide mold for continuous casting comprising the steps of introducing on a continuous basis sheet stock into a central portion of the mold at a particular weight and quantity per unit time by attaching a leading edge of a subsequent sheet to the trailing edge of the previous sheet;

feeding molten metal into the mold in a portion of the mold laterally offset from the central portion into which the sheet stock is introduced; and severing end portions of the casting corresponding to sheet stock free zones in said casting.

2. Method as in claim 1 and including the step of preheating said sheet stock.

3. Method as in claim 1 and including the step of maintaining particular distance of the sheet from the mold wall.

4. Method as in claim 1 there being a plurality of sheets introduced into said mold in parallel relationship and including the step of maintaining particular distance of the sheet from the mold wall and/or from each other during casting.

5. Method as in claim 4 wherein two or more sheets as lowered in parallel are spaced by a distance at least the three-fold value of the thickness of the sheet stock.

6. Method of continuously casting multilayer compound parts under utilization of a mold for continuous casting comprising the steps of, introducing on a continuous basis individual sheet stock into alignment with the mold at a particular weight and quantity per unit time;

lowering the sheet towards a sheet advancing relatively slowly into the mold, and affixing the sheet as lowered with its front edge to the rear edge of the sheet that is being advanced, thereby obtaining a continuous feeding of sheet stock into said mold; and feeding the mold in a portion of the mold laterally offset from the portion into which the sheet stock is introduced.

7. A machine for continuous casting of metal comprising:

a mold with a rectangular cross section for continuous casting;

means for feeding sheet stock into said mold including drive means disposed above said mold for relatively slowly lowering a sheet into the mold, the means for feeding further including transport means disposed above said drive means and said mold for positioning individual sheets sequentially in vertical alignment with the sheet being lowered and lowering said sheet as aligned at a rate faster than the sheet that is being lowered into the mold to permit coupling of the two sheets and to thereby establish continuous feeding of the sheet stock into the mold; and means for feeding molten metal into said mold laterally offset from the area of feeding said sheet stock.

8. A machine as in claim 7 including means for maintaining a sheet as lowered in particular geometric relation to the mold into which it is being lowered.

9. A machine as in claim 8 there being means for feeding a plurality of sheets in parallel into the mold and there being means for maintaining a particular spacing of the sheets in relation to each other.

10. A machine for continuous casting of metal comprising:

a mold with a rectangular cross section for continuous casting;

a U-shaped tundish having at the respective end of the legs casting pipes dipping into the mold near end portions thereof;

means for feeding sheet stock into said mold disposed so that said sheet stock is being fed into the central portion of the mold in between said casting pipes; and means for feeding molten metal into said mold laterally offset from the area of feeding said sheet stock.

11. Apparatus as in claim 10 including means for feeding molten metal into said tundish near the bottom portion of the U.

12. Apparatus as in claim 7 including rail means and holding means running on the rail means for moving sheets into the vertical alignment with said mold further including drive means disposed above the mold for lowering a sheet into the mold.

13. Apparatus as in claim 7 wherein two or more sheets are lowered in parallel relationship into the mold, and including store means for the sheet stock wherein said sheets are stored already having a desired spacing between them during lowering into the mold.

* * * * *